US005335282A

United States Patent [19]

Cardas

[11] Patent Number: 5,335,282

[45] Date of Patent: Aug. 2, 1994

[54] SIGNAL SUMMING NON-MICROPHONIC DIFFERENTIAL MICROPHONE

[76] Inventor: George F. Cardas, 480 Eleventh St., South East Bandon, Oregon 97411

[21] Appl. No.: 918,421

[22] Filed: Jul. 22, 1992

[51] Int. Cl.[5] ..... H04R 3/00

[52] U.S. Cl. ..... 381/92; 381/113

[58] Field of Search ..... 381/92, 113, 114

[56] References Cited

FOREIGN PATENT DOCUMENTS 3102530 11/1981 Fed. Rep. of Germany ..... 381/92

3102208 12/1981 Fed. Rep. of Germany ..... 381/92

OTHER PUBLICATIONS

Funkschau, 1980, Heft 19, p. 79, "Zoom-Mikrofon".

*Primary Examiner*—Forester W. Isen

*Attorney, Agent, or Firm*—Boniard I. Brown

[57] ABSTRACT

A microphone comprises a plurality of oppositely oriented electroacoustic transducer pairs arranged in a body or a resonator cavity and electrically algebraically summed, whereby ambient acoustic shock impulses and vibration induce opposite electrical phase output, while an audio signal entering an acoustic channel to the transducer cavity produces a damped, in-phase, summed output, greatly enhancing the signal to noise ratio and producing a high output level that is substantially non-microphonic.

3 Claims, 2 Drawing Sheets

SIGNAL SUMMING NON-MICROPHONIC DIFFERENTIAL MICROPHONE

BACKGROUND OF THE INVENTION

The present invention relates generally to microphones for voice and music, and more particularly to an improved pressure microphone having superior vibration and noise rejection. Heretofore, pressure microphones have generally comprised a single, approximately planar vibratile element or diaphragm open to ambient sound or pressure variations on one side and essentially sealed from these variations on the other. The position of the diaphragm at any instant is related to the difference between ambient pressure on the open side and the pressure of the sealed volume of air on the opposite side. Various transduction means are utilized to convert these variations in position to electrical signals, which signals ideally become replicas of the ambient pressure variations. Added to these signals, however, are the undesired diaphragm motions, caused by mechanical vibration transmitted through the microphone structure, and by noise contributed by electrical resistance of the transducing means or succeeding stages of amplification. Prior art means for increasing the sensitivity, and thus the signal-to-noise ratio, of microphones have generally involved increasing the size of the vibratile element or improving the efficiency of the transducing means whereby diaphragm motion is converted into electrical signals. In the latter case, any increase in transduction efficiency results in a like increase in efficiency for structure-borne vibration and shock-induced signals.

One means for improving overall efficiency of a microphone, as disclosed in U.S. Pat. No. 3,980,838 to Yakushiji, et al., involves electrostatic diaphragms disposed about a perforate common electrode. The device is used as a loud speaker approximating a plate the thickness of which grows and shrinks to follow the waveform being reproduced. The technique of dual diaphragms about a common perforate electrode is disclosed as early as 1935 in U.S. Pat. No. 2,179,361 to von Braunwahl, et al., the object being to provide a directional response.

An example of a microphone of the prior art is the aircraft radio noise cancelling microphone, which has a single transducer and a bidirectional acoustic channel driving the transducer from opposite directions, whereby bidirectional balanced pressures, such as ambient noise, are substantially cancelled. Acoustically unbalanced voice pressure enables substantially noise-free microphone output and improved dynamic range.

SUMMARY OF THE INVENTION

The present invention provides a plurality of electroacoustic transducers, each one incorporating a substantially planar vibratile member or diaphragm open to an enclosed volume of air on one side, and open to a shared volume of air on the opposite side, which chamber is at least partially open to the ambient air. A pressure increase in the ambient air, and hence in the air inside the chamber, causes each diaphragm to move toward its own enclosed volume of air, producing a positive output signal in each case. The diaphragms may be arranged to be substantially parallel and opposed so that vibration or shock will cause one to move toward its enclosed volume of air while the other moves oppositely in the direction away from its enclosed volume of air. The outputs of the transducers are connected in phase such that in-phase signals add while out-of-phase vibration and shock impulses cancel.

In accordance with the invention, a plurality of transducers, the individual outputs of which are summed electrically, increases the output level of the microphone for a given acoustic input level. A common-mode-rejection connection of the summed transducers eliminates output of balanced ambient pressure differentials so that only the signal, e.g., voice, is output from the microphone. This enables a high level output microphone that is substantially non-microphonic. Any acoustic, e.g., voice signal, is applied to each transducer in one direction to cause a pressure differential across the transducers' arrangement, producing an electrically summed output of the two transducers.

A primary object of the invention is to provide a microphone for audio frequencies in the range between 20 and 20,000 Hertz that is substantially immune to shock and vibration, is substantially non-microphonic, and has high output.

It is another object of the invention to provide a microphone having an output level high enough to be used without a preamplifier in some configurations of the invention,—i.e., about −20 dBm instead of the prior art output level of approximately −60 dBm.

Another object of the invention is to utilize existing state of the art microphone transducers in redundant configurations and sum their outputs to increase the output level of the microphone.

Another object of the invention is to utilize existing microphone transducers in redundant common mode rejection configurations and sum their outputs to increase the signal-to-noise ratio output of the microphone.

A further object of the invention is to utilize existing microphone transducers in angularly directed configurations and sum their outputs to substantially cancel ambient shock and vibration and provide a high output level of the microphone.

Yet another object of the invention is to utilize relatively inexpensive microphone transducers in redundant configurations and sum their outputs to increase the output level of a microphone, and broaden its frequency response by staggering frequency characteristics of the individual transducers to obtain board-band output.

DESCRIPTION OF THE PREFERRED EMBODIMENTS

Figure 1:
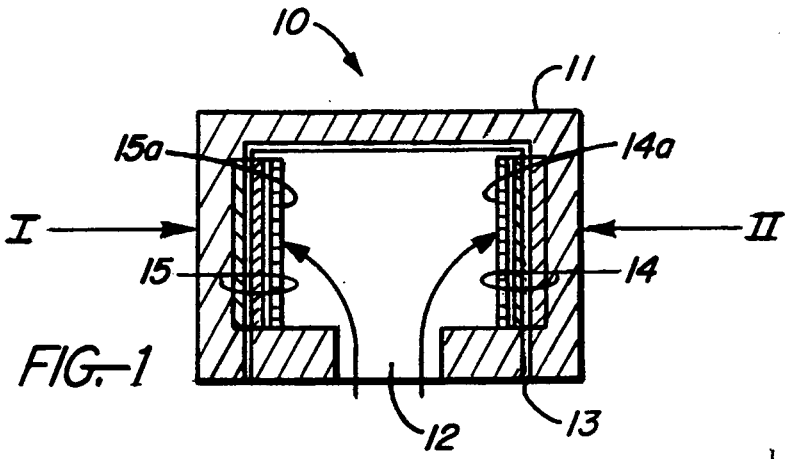
FIG. 1 is a cross-sectional view of a generic configuration of a microphone according to the present invention.

Referring to FIG. 1, there is shown a cross-sectional view of a generic configuration of a microphone in accordance with the invention. For illustrative purposes, in this embodiment, a pair of electret type microphones is depicted, although the carbon granule type of microphone commonly used in a high noise environment, such as the cockpit of an aircraft, could be used because of its ruggedness. It has a single transducer and acoustic, rather than electrical, noise cancelling. The body 11 of the microphone 10 has acoustic signal channel 12 and an ambient air volume vented through channel 13. The acoustic channel includes first and second microphone transducers 14, 15, each having a diaphragm responding to variations in pressure at audio frequencies. It will be understood that any ambient sound vibration, due to an environmental impulse, entering in either or both of the directions of arrows I and II (FIG. 1) will be balanced out if the transducers have equal outputs and are connected in algebraic summation, i.e., electrical phase addition. However, when a localized directed sound enters from the same direction, the unbalanced acoustic pressure encounters both diaphragms in the same direction, thus producing approximately double the output. If I or II pressure impulses come from one direction, the electrical output will be proportional to the sum of I and II, and because diaphragms 14*a* and 15*a* will move in the direction of the impulse, the output will be zero. Similarly, if electrets 14 and 15 receive a signal at the channel 12, diaphragms 14*a*, 15*a* will move in the positive phase direction and will be additive.

Figure 2:
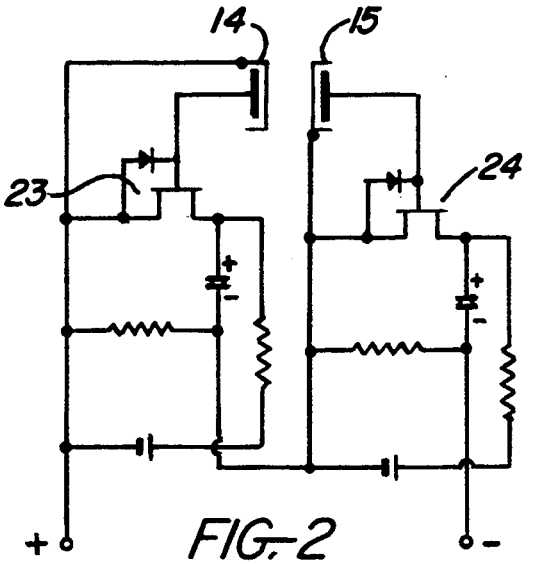
FIG. 2 is a schematic diagram of an embodiment of an algebraic summing circuit particularly for use with high impedance capacitive microphone transducers in accordance with the invention.

FIG. 2 shows an embodiment of the algebraic summing circuit particularly suited to high impedance capacitive microphone transducers 14, 15, such as the electrets 14, 15 of FIG. 1, wherein the capacitive transducers' outputs are applied to field effect transistor amplifiers 23, 24, such that the unidirectional acoustic excitation of the transducers in normal use of the microphone causes voltages at the amplifiers to sum the transducers 14, 15 outputs and produce approximately twice the output for a single microphone.

Figure 3:
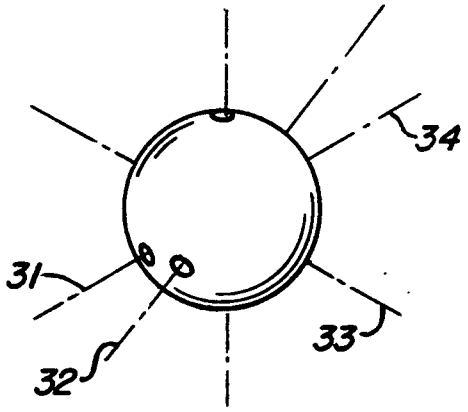
FIG. 3 shows a general arrangement of placement of a plurality of pairs of transducers in a spherical or hemispherical configuration to cancel directed shock and vibration at any desired angle.

In view of the algebraic addition of signals and subtraction of shock and vibration impulses, it will be understood that the microphone of FIGS. 1 and 2 may be produced by placing a plurality of pairs of microphones in a spherical or hemispherical configuration, as indicated in FIG. 3, to cancel directed shock and vibration at any desired angle, such as those indicated at 31, 32, 33, 34. The transducer pairs then have their associated outputs summed in a common resistor network to develop a summed voltage approximately equal to the instantaneous output of all the transducer pairs minus any unbalanced environmental impulses that have not been cancelled by the opposing transducers. The output of the summing microphone would then be approximately 6 dB per pair of transducers with a very high signal to noise ratio.

Figure 4:
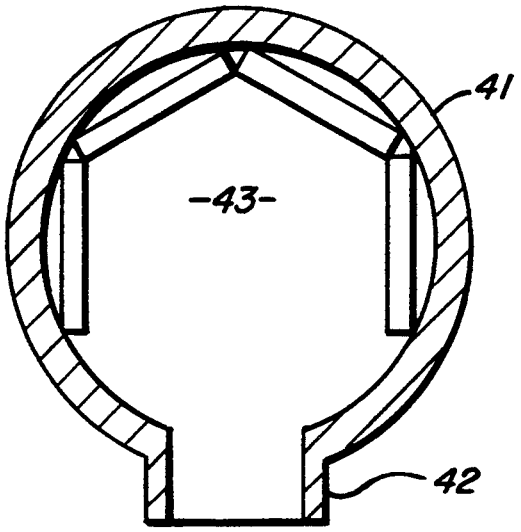
FIG. 4 is a sectional view of an embodiment of a summing microphone in combination with a quasi Helmholtz resonator, in an embodiment of the invention.

FIG. 4 depicts embodiment of the invention wherein a summing microphone is combined with a quasi Helmholtz resonator having a flask-like body 41 and an entry column 42. The mass reactance of the short column of air neutralizes, at a fairly definite frequency, the reactance of the stiffness of the volume 43 contained in the enclosure 41 which communicates with the open air only through the column 42. The length of column 42 is selected for best diaphragm damping characteristics.

In a preferred embodiment of the invention, the microphone transducers are so disposed as to be spaced about every 45 degrees relative to a plane through the Helmholtz resonator input, thus to more effectively cancel out microphone pickup caused by ambient vibration, such as shock impulse and microphonism, by means of the electrically differentially connected, oppositely disposed transducers, while the unidirectional acoustic signal is summed in the outputs of all of the transducers.

Figure 5:
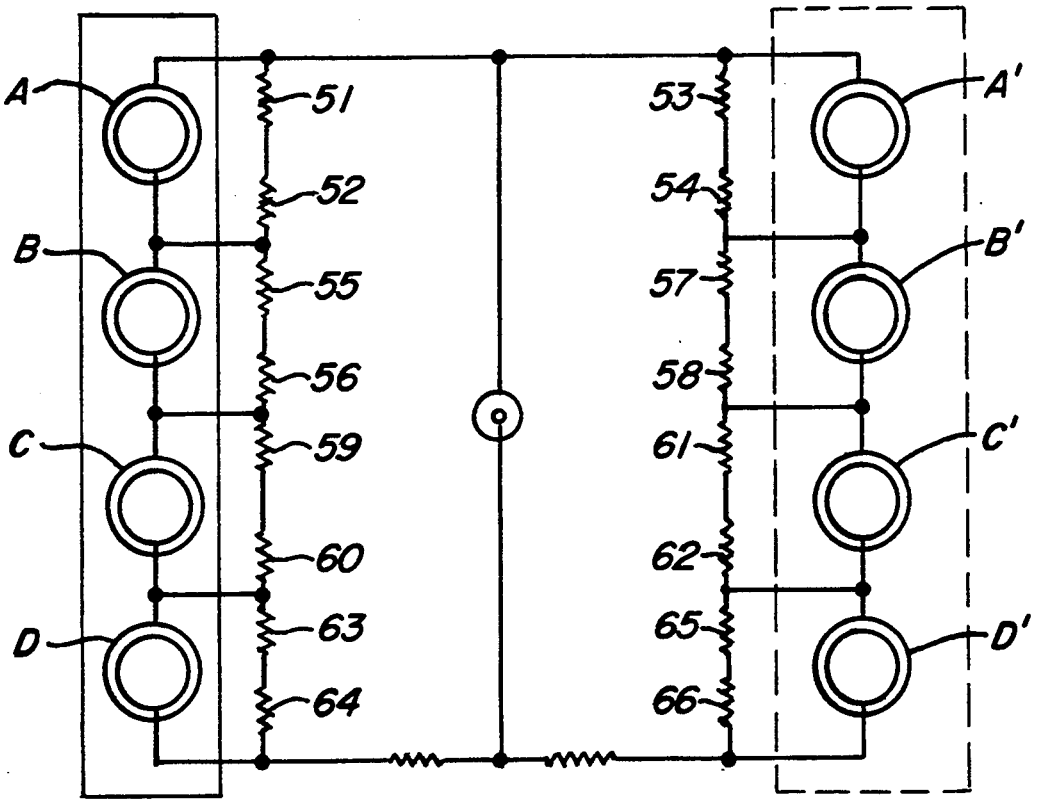
FIG. 5 is a schematic diagram of an alternative embodiment of the invention having a summing network for four pairs of oppositely disposed transducers.

FIG. 5 illustrates an alternative embodiment of the invention which utilizes a summing network for four pairs of oppositely disposed transducers, each pair being amplified, as in the circuit of FIG. 2. For example, the instantaneous voltage output from the amplifier of opposing pair A–A′ would be developed across resistors 51, 52, 53, 54. The instantaneous voltage output from the amplifier of opposing pair B–B′ would be developed across resistors 55, 56, 57, 58. The instantaneous voltage output from the amplifier of opposing pair C–C′ would be developed across resistors 59, 60, 61, 62. The instantaneous voltage output from the amplifier of opposing pair A–A′ would be developed across resistors 63, 64, 65, 66.

The instantaneous summed voltage output would be approximately four times the differential output of a single pair of transducers, and would be amplified by a common amplifier which receives the output.

Figure 6:
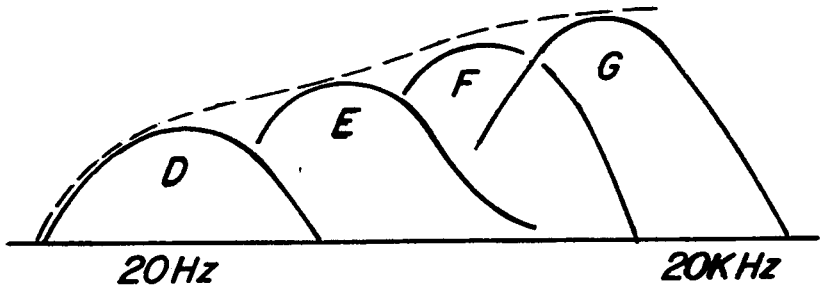
FIG. 6 shows a technique for combining responses of a plurality of different transducers to shape microphone frequency response.

It is well known in the art that different types of microphone transducers may have different frequency responses, i.e., greater output in different portions of the audio frequency spectrum. The invention, which sums transducer outputs, is well suited to combining the attributes of individual transducers, thus providing a broad band output using relatively inexpensive transducers of a plurality of types. For example, an electrodynamic microphone, which has a frequency response increasing with frequency, could have its output summed with a transducer of the carbon or crystal type which can have an extended low frequency output, and/or an electrostatic transducer having an extended high frequency response. This technique for combination of responses is illustrated in FIG. 6, wherein response curve D may result from an electrodynamic transducer pair, response curve E may result from a low frequency crystal transducer pair, response curve F may result from a capacitive transducer pair, and response curve G may result from an electret electrostatic or capacitive microphone transducer pair. The summed microphone output level is the combined frequency range at the peak levels of each type of transducer.

Thus there has been shown and described a novel signal summing non microphonic differential microphone which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. A microphone for converting sound pressure variations to electrical signals having a positive phase when acted upon by a force in a first direction and a negative phase when acted upon by a force in the opposite direction, said microphone comprising:

at least a first pressure transducer acoustically coupled to the environment and having an electrical output of a first phase, at least a second pressure transducer oriented oppositely to said first pressure transducer and acoustically coupled to said first pressure transducer to produce an electrical output of the same phase as said first pressure transducer, and circuit means combining the electrical output of said first pressure transducer and the electrical output of the said second pressure transducer, said circuit means comprising a number of field-effect or bipolar transistors having their respective gates connected to their respective transducer outputs of the same number as the transistor, the sources and drains of said transistors being so connected that the amplified signal outputs of the transducers are superimposed in series, whereby an acoustic signal directed to both the first and second transducers produces output phases that are additive, and a randomly directed pressure impulse produces both positive and negative output phases which electrically cancel the oppositely oriented transducers, and the outputs of the transducers are combined to increase the output level of the microphone in relation to the number of transducers.

2. A microphone according to claim 1, wherein:

each of the first and second transducers comprises at least a pair of transducers having different frequency responses, whereby a plurality of pairs of transducers provides extended frequency output of said microphone.

3. A summing microphone comprising: a plurality of transducer pairs oriented at about 45 degrees about the center of a spherical cavity, each pair including at least a first pressure transducer and a second pressure transducer, the first pressure transducer being acoustically coupled to the environment and having an electrical output of a first phase, the second pressure transducer being oriented oppositely to said first pressure transducer and acoustically coupled to said first pressure transducer, thus to produce an electrical output of the same phase as said first pressure transducer, and summing network means receiving the electrical output of said first pressure transducer and of said second pressure transducer of said plurality of transducer pairs, thus producing the sum of the outputs of said plurality of transducer pairs.

* * * * *